US005533698A

United States Patent [19]

Puig-Sureda Font

[11] Patent Number: 5,533,698

[45] Date of Patent: Jul. 9, 1996

[54] SUPPORTING DEVICE, ESPECIALLY CONCEIVED FOR FISH BOWLS

[75] Inventor: Jose Puig-Sureda Font, L'Ametlla del Valles, Spain

[73] Assignee: Occoris, S.A., Cardedeu, Spain

[21] Appl. No.: 333,476

[22] Filed: Nov. 2, 1994

[30] Foreign Application Priority Data

Nov. 5, 1993 [ES] Spain ..... P9302317

[51] Int. Cl.[6] ..... A47G 23/02

[52] U.S. Cl. ..... 248/152; 248/149; 248/188.3; 248/371

[58] Field of Search ..... 248/133, 139, 248/140, 143, 149, 150, 152, 371, 345.1, 184, 188.2, 188.3; 108/157; 119/247, 253, 269; 211/186

[56] References Cited

U.S. PATENT DOCUMENTS

| | | | |
|---|---|---|---|
| 396,372 | 1/1889 | Schreiber | 248/149 |
| 2,254,939 | 9/1941 | Elias | 248/150 |
| 2,434,800 | 1/1948 | Hollander | 248/150 |
| 2,829,934 | 4/1958 | Schulze | 108/157 |
| 4,839,498 | 6/1989 | Chak | 119/269 X |

*Primary Examiner*—Alvin C. Chin-Shue
*Assistant Examiner*—Korie H. Chan
*Attorney, Agent, or Firm*—Darby & Darby

[57] ABSTRACT

A supporting device especially designed for fish bowls provides a high degree of rigidity and horizontality, while at the same time it can be adapted to the bendings of the bottom of the fish-bowls, so that the distribution of weights throughout the supports is homogeneous. It incorporates two H-shaped pieces (1) facing each other and braced by means of two L-shaped elements (2) formed by two plates folded forming two dihedrons which serve as two upper edges. Two swinging profiles (3), forming the supporting base of the fish-bowl or the object to be supported, are fitted to such upper edges.

10 Claims, 3 Drawing Sheets

SUPPORTING DEVICE, ESPECIALLY CONCEIVED FOR FISH BOWLS

FIELD OF THE INVENTION

This invention relates to a supporting device for fish bowls or tanks which provides an adequate and easy-to-construct base to support same.

BACKGROUND OF THE INVENTION

Fish bowls and tanks are relatively fragile and, since they incorporate a great volume of water, their walls and bottoms must withstand great pressures. This certain strains or bendings that make them lose the initial flat form of their surfaces.

On the other hand, it is very important to keep these fish tanks or bowls horizontal, to avoid any pressure distribution unbalances.

There are many types of well-known supports for fish tanks which are usually classified into two groups. One of these groups includes wooden supports or furniture. Such wooden supports present inconveniences such as the fragility and attention inherent to such building materials and their high cost.

Another group includes metallic supports which are typically made with tubes of rectangular section to define a four leg structure having different bracing beams and a series of crosspieces or horizontal upper frame members which constitute the supporting base for the tank. These metallic supports or structures solve the inconvenience of the high cost previously mentioned. However, such metallic supports present other inconveniences.

One such inconvenience is that the iron tubes forming the metallic supports which are available in the market are not very reliable, as far as their straightness is concerned" since they are not straight and squared enough and the supporting base thus configured is not completely flat.

On the other hand, the sections of these tubes are made relatively small for economic reasons, and the weight of the tank, for example, entails a series of strains on the support. Therefore, the frame or upper supporting surface bends downwards and the strain supported at the bottom of the tank by the frame is greater at the ends than at the center, instead of distributing it homogeneously throughout the whole length of such bottom.

These inconveniences introduce overpressure and problems that, on some occasions, may lead to accidents and breakages of the fish bowls, along with the relevant risks.

OBJECTS AND SUMMARY OF THE INVENTION

An object of this invention is to obtain, at a low cost and in an easy manner, a support which adapts itself to the bottom of a tank deposited on it.

Another objects to provide a support having a very rigid structure to avoid swinging and to provide stability to a tank supported thereon.

In order to achieve these goals and to avoid the inconveniences of prior designs, the invention comprises a support device, especially for fish tanks, with three different main pairs of elements.

One of the elements has an "H" shape, with a double central section, i.e., it is formed by two vertical parallel columns connected by two parallel crossbars. Such columns and cross bars are preferably hollow and with rectangular cross-sections.

The supporting device according to the invention incorporates two elements of this type, to form the four legs and the seating areas for the other elements.

Another of the elements is a rectangular plate which is folded to form a right angle, so that its cross section is constant and has an "L" shape. The outer edge of the horizontal or lower section of such "L" is folded upwards to form a dihedron to house small fish bowl accessories, lighting devices, wirings, etc.

The L-shaped elements are arranged to face each other, and they are preferably fixed by means of screws at the inner sides of the vertical columns of the H-shaped elements, so that the whole support device is rigidly braced, while the upper ends of the H-shaped elements are joined by means of the L-shaped elements. The support device also has a pair of upper edges which provide a straightness to the device which corresponds to the respective upper ends of the vertical section of each L-shaped elements. Such straightness is due to the great cutting accuracy of the plates which form the L-shaped elements.

A third element of the support device has a T-shaped cross section, the bottom end of such T having a recess or slot extending its whole profile, and has a width slightly greater than the thickness of the plates which form the L-shaped elements.

Each of a pair of T-shaped elements is mounted on an upper edge of the support device such that the slot or longitudinal recess of the profile fits over the relevant edge. The T-shape profile can swing inwards and outwards relative to the rest of the support device, until it reaches the same plane as the bottom of the tank.

According to the invention, such swinging is enabled and limited by a trapezoid shape imparted to the slot and by the adequate proportions of the slot or recess of the profile, which enable the adaptation to any bending of the bottom of the tank without any loss of horizontality and with a homogeneous and balanced distribution of weights since the whole upper surface of each profile is the area where the bottom of the tank is supported.

These advantages are achieved with the configuration and structure of the invention. Among these advantages is the obtention of a series of flat supporting edges due to the cutting accuracy of the relevant plates, without any possibility of strains due to the height of the L-shaped elements.

Furthermore, the L-shaped elements provide rigidity to the support device assembly, since they define bracing, while providing some shelves to house wires and accessories at their horizontal or lower section.

On the other hand, the location of the swinging profiles ensures that the supports are more centered, which is not the case in many other conventional supports, and ensures that the weight is distributed in a more evenly manner. The swinging of such profiles enables the bottom of the tank to coincide with the whole upper surface of the profiles. The swinging self-adapts the support device to any eventual bendings of such bottom. Therefore, the support device assembly presents great homogeneity and stability of support.

In an effort to better understand the invention, a set of drawings has been attached where, as an illustration and without limitation, the objects of the invention have been represented.

DETAILED DESCRIPTION OF AN EMBODIMENT

An example of the invention is described in the following paragraphs with reference to the numbering system used for the figures.

Figure 1:
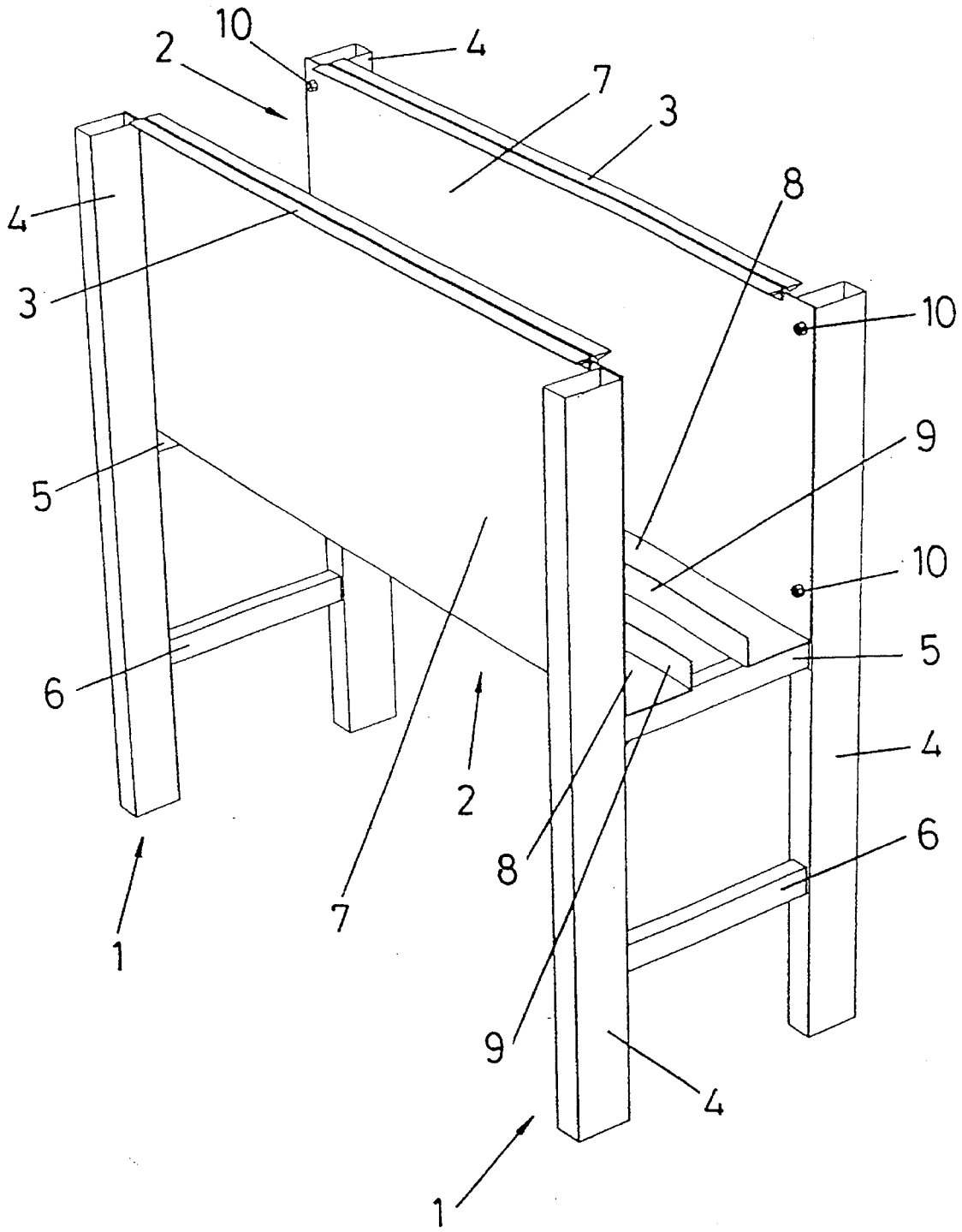
FIG. 1 shows a perspective view of an assembled supporting device for fish tanks, according to the invention.

In FIG. 1, the supporting device especially conceived for fish tanks is described. In this embodiment, three pairs of elements 1, 2 and 3 comprise the support device. These elements are preferably metallic. Each has different shapes and functions.

Each element 1 in the pair presents a "H" shape determined by two vertical upright columns 4, preferably hollow and with a rectangular section. These two columns 4 are joined by means of an upper horizontal cross bar 5 and by a lower cross bar parallel to the previous one.

The H-shaped elements 1 face each other, and provide four legs for the support device and a set of areas to support and fix the remaining elements.

Figure 2:
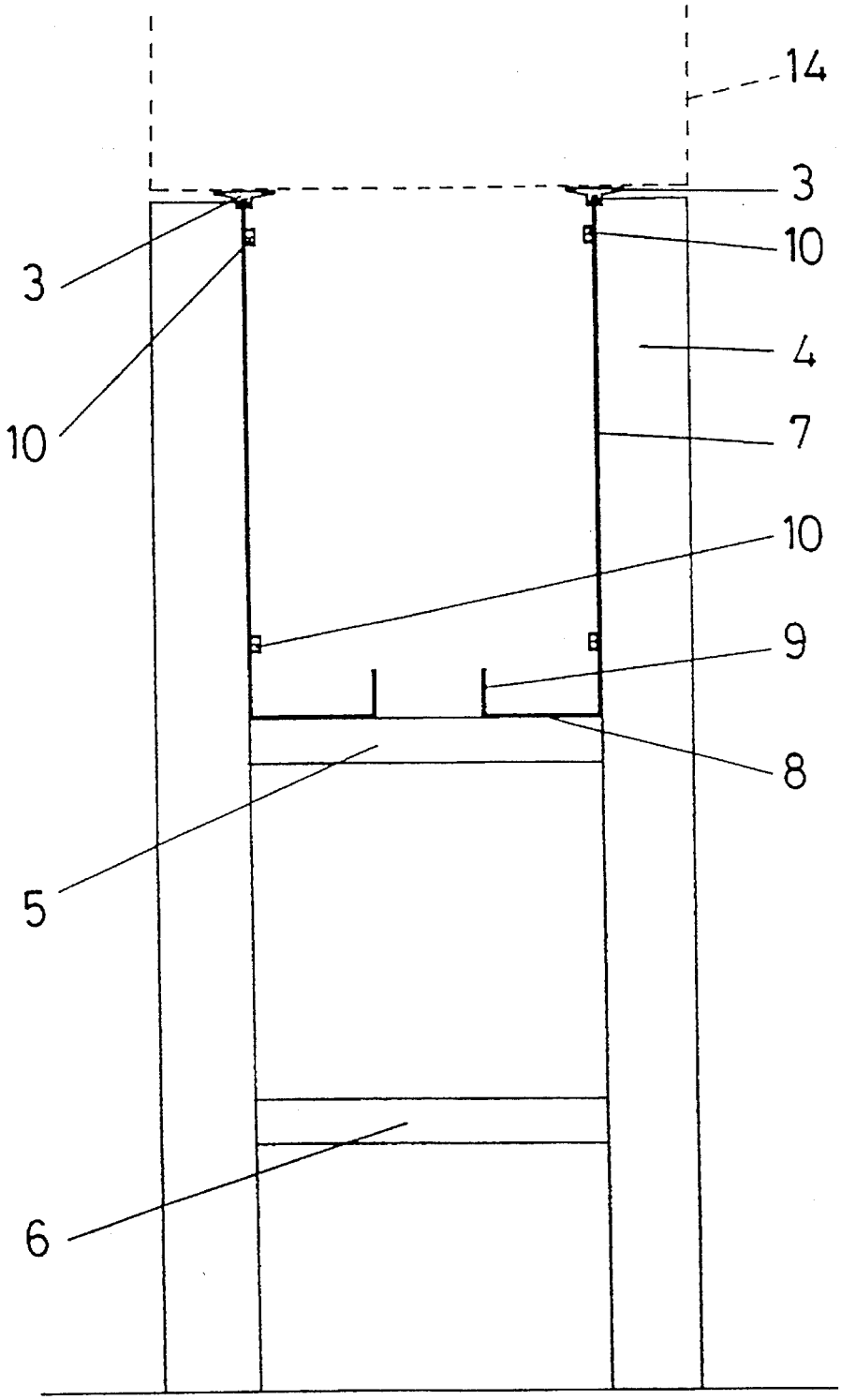
FIG. 2 shows a side view of the supporting device of FIG. 1, showing in phantom the bottom line of the fish tank deposited on it.

As seen in FIG. 2, each element 2 has an "L" shape defined by a rectangular plate folded along two parallel lines forming two dihedrons orientated towards the same direction, so that they form a high side wall 7, a smaller bottom 8, and a little vertical flange 9, parallel to the above-mentioned wall 7. Bottom 8 provides a shelf to house accessories, wires and other similar devices.

The L-shaped elements 2 are placed on the upper cross elements 6 on the inner sides of the columns 4, L-shaped elements 2 are preferably fixed to such columns by means of screws 10, the upper edge of the walls 7 being flush with the upper ends of the columns 4.

This structure confers a great rigidity and squaring to all the elements, because the cross elements 5 and 6 and the L-shaped elements 2 define an excellent bracing. Furthermore, the upper edges of the walls 7 provides an edge with a high degree of reliability, due to the accuracy of the cutting required to form the plates of such L-elements. On the other hand, the strains along such edges due to an overweight tank are practically non existent due to their configuration, especially when the relevant pressure is evenly exercised throughout the whole edge by element 3, described next.

Figure 3:
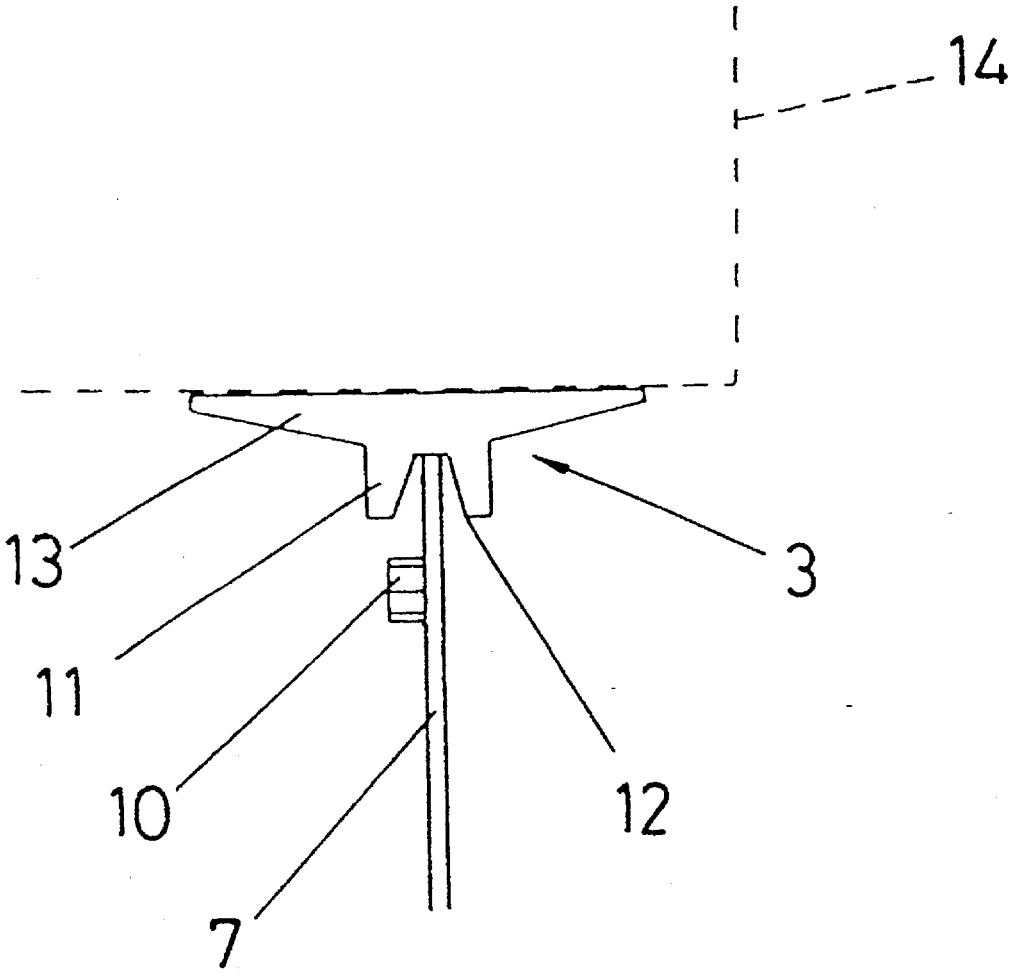
FIG. 3 shows a partial view of the supporting device in which the details corresponding to the coupling of the swinging profiles and the upper edges of the L-shaped elements are shown.

Each element 3 has a straight profile along its upper section 13 and has a T-shaped cross-section (see FIG. 3), the lower section 11 of which has a trapezoidal recess 12. An element or profile 3 is placed on a respective upper edge of side wall so that such elements 3 can slightly swing transversely, while the area corresponding to the upper section 13 of the T forms an adequately flat supporting base to place the bottom of the tank 14, or other element to be located on the supporting device.

This possibility of swinging of the elements 3 enables their total adaptation to the slight bendings that might eventually arise at the bottom of the tank 14, although the above-mentioned elements have their upper sections 13 kept longitudinally horizontal.

I claim:

1. A supporting device for a fish tank, comprising:

first and second opposed leg structures each having two upright legs, said legs being connected by a first crossbar;

first and second plates each having an upper edge, said first and second leg structure being connected together by said first and second plates; and two elongated profiles, each of said profiles comprising a flat upper surface to support the fish tank and a bottom surface including means for pivotally mounting said profile on said upper edge of said plates;

whereby said profiles adapt to any bending in the fish tank by pivoting transversely to their length while supporting the fish tank along their length.

2. The supporting device as in claim 1, wherein each of said first and second leg structures comprises a generally "H" shaped element, said two vertical legs are parallel and define an upper portion and a lower portion, said vertical legs being connected by said first crossbar and a second crossbar.

3. The supporting device as in claim 2, wherein said first and second leg structures have a hollow, rectangular cross-section.

4. The supporting device as in claim 2, wherein said first lateral end of each one of said plates is fixed to said upper portion of the corresponding leg of said first leg structure, and wherein said second lateral end of each one of said plates is fixed to said upper portion of the corresponding leg of said second leg structure.

5. The supporting device as in claim 2, wherein said lower horizontal parts of said plates are situated on said upper crossbar of each of said leg structures.

6. The supporting device as in claim 1, wherein each of said first and second plates includes a right angle to define a generally "L" shaped element comprising an upper vertical part and a lower horizontal part, each of said first and second plates having a first and second lateral end.

7. The supporting device as in claim 6, wherein said first lateral end of each one of said plates is fixed to an upper portion of the corresponding leg of said first leg structure, and wherein said second lateral end of each one of said plates is fixed to an upper portion of the corresponding leg of said second leg structure.

8. The supporting device as in claim 6, wherein said lower horizontal parts of said plates are situated on said upper crossbar of each of said leg structures.

9. The supporting device as in claim 1, wherein said elongated profiles define a generally "T" shaped element comprising said flat upper surface and a vertical part which extends to said bottom surface, and wherein said means for pivotally mounting said profile onto said upper edge of said plates comprises a trapezoidal recess in said vertical part, said trapezoidal recess extending the length of said bottom surface of said elongated profile.

10. The supporting device as in claim 9, wherein said elongated profiles pivot in a direction transverse to the direction of elongation.

* * * * *